US007527044B2

(12) United States Patent
Dunkle et al.

(10) Patent No.: US 7,527,044 B2
(45) Date of Patent: May 5, 2009

(54) SMALL ENGINE CARBON CANISTER WITH CHECK VALVE

(75) Inventors: Gary L. Dunkle, Connersville, IN (US); Josh J. Mullins, Connersville, IN (US); Louis T. Frank, Connersville, IN (US)

(73) Assignee: Stant Manufacturing Inc., Connersville, IN (US)

( * ) Notice: Subject to any disclaimer, the term of this patent is extended or adjusted under 35 U.S.C. 154(b) by 0 days.

(21) Appl. No.: 11/553,776

(22) Filed: Oct. 27, 2006

(65) Prior Publication Data

US 2007/0251510 A1 Nov. 1, 2007

Related U.S. Application Data

(60) Provisional application No. 60/731,205, filed on Oct. 28, 2005.

(51) Int. Cl.
*F02M 33/02* (2006.01)

(52) U.S. Cl. ..... 123/519; 123/520

(58) Field of Classification Search ..... 123/516–519, 123/520

See application file for complete search history.

(56) References Cited

U.S. PATENT DOCUMENTS 3,854,911 A * 12/1974 Walker ..... 96/144
3,937,198 A * 2/1976 Sudhir ..... 123/519
3,957,025 A * 5/1976 Heath et al. ..... 123/518
4,031,869 A * 6/1977 Onishi et al. ..... 123/406.7
4,083,344 A * 4/1978 Sakurai et al. ..... 123/520
4,173,207 A * 11/1979 Hiramatsu ..... 123/519
4,193,383 A * 3/1980 Rogers ..... 123/520
4,245,592 A * 1/1981 Atkins, Sr. ..... 123/572
4,338,106 A * 7/1982 Mizuno et al. ..... 96/139
4,338,905 A * 7/1982 Urich ..... 123/525
4,381,929 A * 5/1983 Mizuno et al. ..... 96/130
4,386,947 A * 6/1983 Mizuno et al. ..... 96/137
4,507,132 A * 3/1985 Yoshida ..... 96/139
4,702,216 A * 10/1987 Haruta et al. ..... 123/520
4,748,959 A * 6/1988 Cook et al. ..... 123/406.45
4,877,001 A * 10/1989 Kenealy et al. ..... 123/519
5,054,453 A * 10/1991 Onufer ..... 123/516
5,058,693 A * 10/1991 Murdock et al. ..... 180/69.4
5,191,870 A * 3/1993 Cook ..... 123/520
5,386,812 A * 2/1995 Curran et al. ..... 123/520
5,427,076 A * 6/1995 Kobayashi et al. ..... 123/520
5,448,980 A * 9/1995 Kawamura et al. ..... 123/520
5,546,913 A * 8/1996 Aoki ..... 123/520
5,562,083 A * 10/1996 Osanai ..... 123/519
5,632,251 A * 5/1997 Ishikawa ..... 123/519
5,697,348 A * 12/1997 Schwager ..... 123/520
5,803,054 A * 9/1998 Yamazaki et al. ..... 123/519
5,813,427 A * 9/1998 Huh ..... 137/202
6,353,955 B2 * 3/2002 Araki et al. ..... 123/516
6,732,718 B2 * 5/2004 Kano et al. ..... 123/518
2005/0274364 A1 12/2005 Kirk et al.

* cited by examiner

*Primary Examiner*—Thomas N Moulis
(74) *Attorney, Agent, or Firm*—Barnes & Thornburg LLP

(57) ABSTRACT

A power source is provided for a machine. The power source includes an engine and an engine fuel system of the type that generates fuel vapor containing hydrocarbon material.

18 Claims, 10 Drawing Sheets

SMALL ENGINE CARBON CANISTER WITH CHECK VALVE

This application claims priority under 35 U.S.C § 119(e) to U.S. Provisional Application No. 60/731,205, filed Oct. 28, 2005, which is expressly incorporated by reference herein.

BACKGROUND

The present disclosure relates to an engine fuel system for outdoor tools such as lawn mowers, and particularly to a fuel vapor venting system for a fuel tank associated with a small internal combustion engine. More particularly, the present disclosure relates to a carbon canister in a fuel vapor venting system.

Engine fuel systems include valves associated with a fuel tank and configured to vent pressurized or displaced fuel vapor from the vapor space in the fuel tank to a separate charcoal canister. The canister is designed to capture and store hydrocarbons entrained in fuel vapors that are displaced and generated in the fuel tank.

SUMMARY

A fuel vapor recovery apparatus comprises a carbon canister, a check valve assembly adapted to be coupled to a vacuum source, and a vapor conduit adapted to be coupled to a vapor space in a fuel tank. The fuel vapor recovery apparatus is included in a power source associated with a small internal combustion engine.

Additional features of the present disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
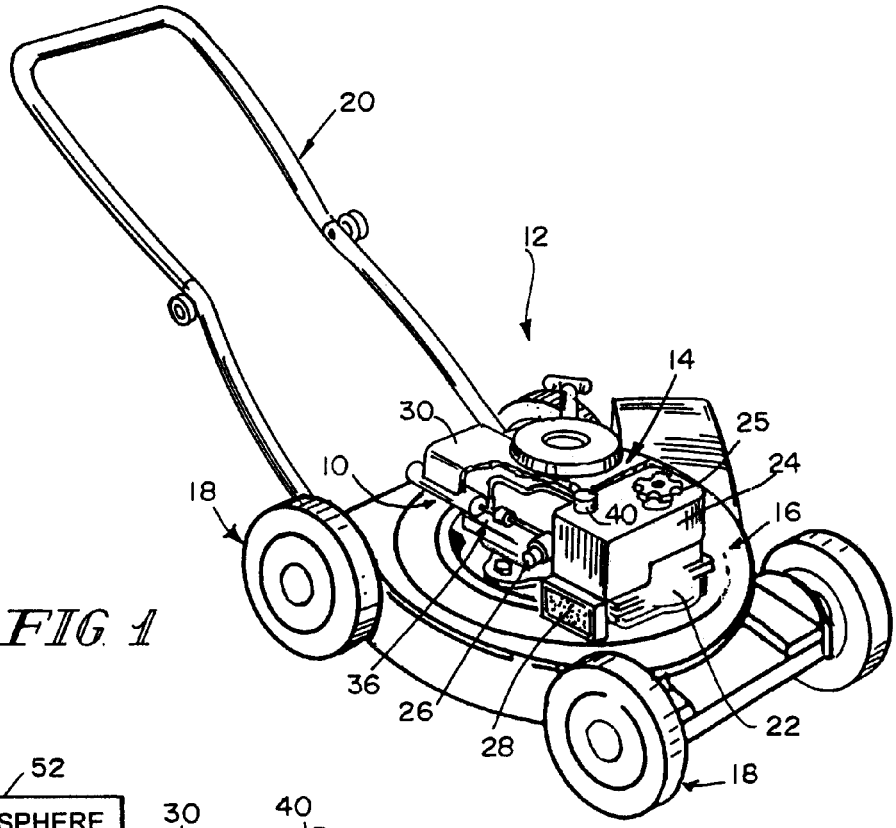
FIG. 1 is a perspective view of a lawn mower including a fuel vapor recovery apparatus in accordance with a first embodiment of the present disclosure and a fuel tank associated with a small internal combustion engine.
Figure 2:
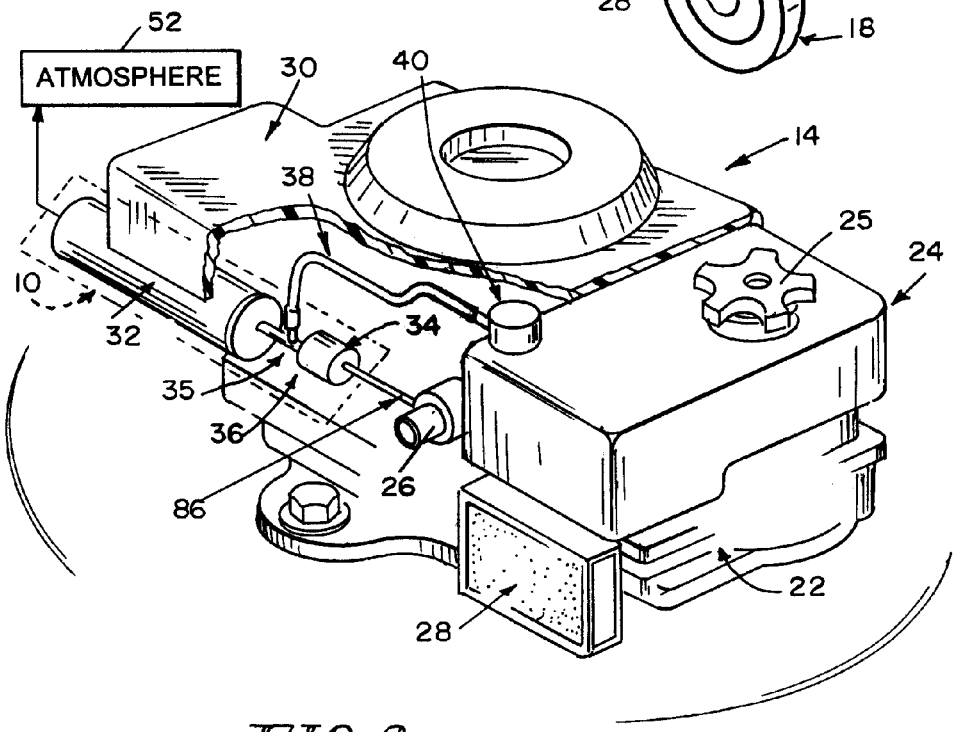
FIG. 2 is an enlarged perspective view of a power source included in the lawn mower of FIG. 1 showing a fuel vapor recovery apparatus comprising a carbon canister, a "one-way" check valve assembly adapted to be coupled to a vacuum source associated with a carburetor, and a T-shaped vapor conduit arranged to interconnect the carbon canister and the check valve assembly and to mate with a vapor line coupled to a rollover valve associated with the fuel tank.

A fuel vapor recovery apparatus 10 in accordance with a first embodiment of the present disclosure is included in a lawn mower 12 as shown, for example, in FIG. 1 and in a power source 14 included in lawn mower 12 as suggested in FIG. 2. A fuel vapor recovery apparatus 110 in accordance with another embodiment of the present disclosure is included in an electricity generator 112 as shown, for example, in FIG. 7 and in a power source 114 included in electricity generator 112 as suggested in FIG. 8. Fuel vapor recovery apparatus 10 is shown in more detail in FIGS. 3-6 while fuel vapor recovery apparatus 110 is shown in more detail in FIGS. 9-12. An alternative fuel vapor recovery apparatus 210 is shown, for example, in FIGS. 13-17.

Lawn mower 12 includes a deck 16 supporting and covering blades (not shown), wheels 18 rotatable on axles coupled to deck 16, a push handle 20 coupled to deck 16, and power source 14 comprising a small internal combustion engine 22, a fuel tank 24 provided with a filler neck closed by fuel cap 25, a carburetor 26, an air filter 28, and a shroud 30 covering a portion of fuel vapor recovery apparatus 10 and lying above deck 16 a shown, for example, in FIG. 1. Shroud 30 can be configured to cover engine 22 and fuel tank 24. It is within the scope of this disclosure to include fuel vapor recovery apparatus 10 in a power source associated with other outdoor tools and/or associated with other small internal combustion engines.

As suggested, for example, in FIG. 2, fuel vapor recovery apparatus 10 includes a carbon canister 32, a check valve assembly 34, and a three-legged vapor conductor 35 arranged to interconnect carbon canister 32 and check valve assembly 34 in fluid communication. Three-legged vapor conductor 35 is T-shaped in the illustrated embodiment. Three-legged vapor conductor 35 is also arranged to mate with a vapor line 38 coupled to, for example, a rollover valve 40 associated with fuel tank 24. In an illustrative embodiment, fuel vapor recovery apparatus 10 comprises a "three-way" vapor conductor 36 comprising three-legged vapor conductor 35 and check valve assembly 34.

Rollover valve 40 regulates flow of fuel vapor and liquid fuel from an interior region of fuel tank 24 to fuel vapor recovery apparatus 10 via vapor line 38. Rollover valve 40 is configured to block discharge of fuel vapor and liquid fuel from fuel tank 24 to fuel vapor recovery apparatus 10 whenever rollover valve 40 is "inverted" or at least tilted a selected number of degrees from its normal upright position to minimize any chance that carbon granules stored in carbon canister 32 will be exposed to liquid fuel during a lawn mower "roll-over" situation.

Figure 5:
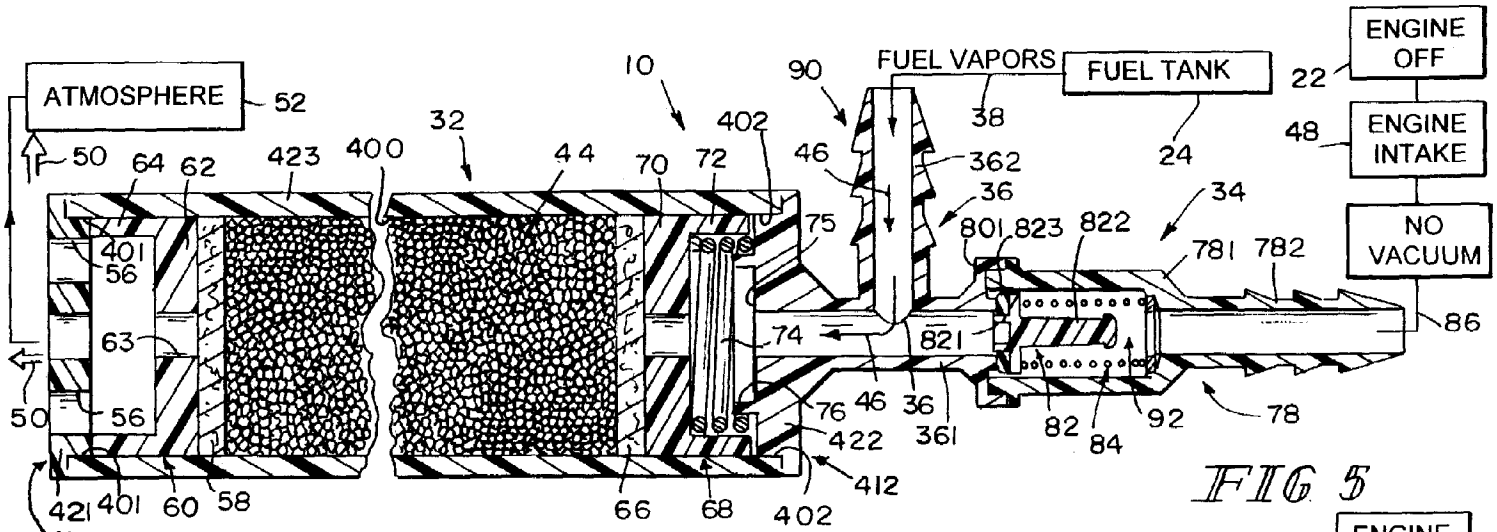
FIG. 5 is an enlarged sectional view taken along line 5-5 of FIG. 3A showing a spring-biased valve included in the check valve assembly in a normal channel-closing position to block flow of fuel vapor extant in the carbon canister through a channel to the engine while the engine is off and showing flow of vented fuel vapor from the fuel tank through the T-shaped vapor conduit to cause hydrocarbons associated with the vented fuel vapor to be captured by a carbon bed in the carbon canister and showing cleaned vapor discharged from the canister to the atmosphere.
Figure 6:
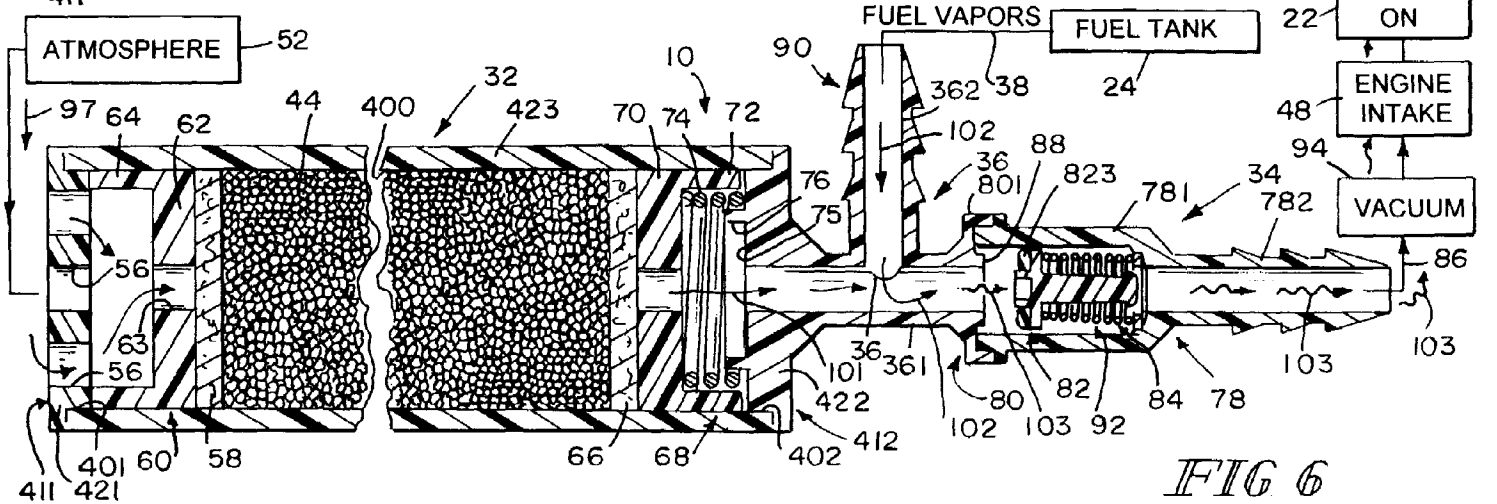
FIG. 6 is a sectional view similar to FIG. 5 showing "purging" of the carbon bed in the canister by means of a purge vacuum applied through an opened channel in the check valve assembly and through the T-shaped vapor conduit to the carbon bed when the engine is running to cause atmospheric air to be drawn through the carbon bed to produce a first stream of fuel vapor (laden with hydrocarbons released from the carbon bed) that mixes with a second stream of fuel vapor discharged from the fuel tank into the T-shaped vapor conduit to produce a fuel vapor mixture that passes through the opened channel in the check valve assembly to the engine (for combustion therein) while the spring-biased valve is moved (by the purge vacuum) to a temporary channel-opening position.

Canister 32 has a housing 42 containing a carbon bed 44 as suggested in FIGS. 5 and 6 and is sized to fit into a canister-receiving cavity provided under shroud 30 in power source 14 as suggested in FIG. 1. Housing 42 is formed to include an interior region 400 containing carbon bed 44, an atmosphere orifice 401 opening into interior region 400, and a tank-and-engine orifice 402 opening into interior region 400 as suggested in FIGS. 5 and 6.

Figure 3A:
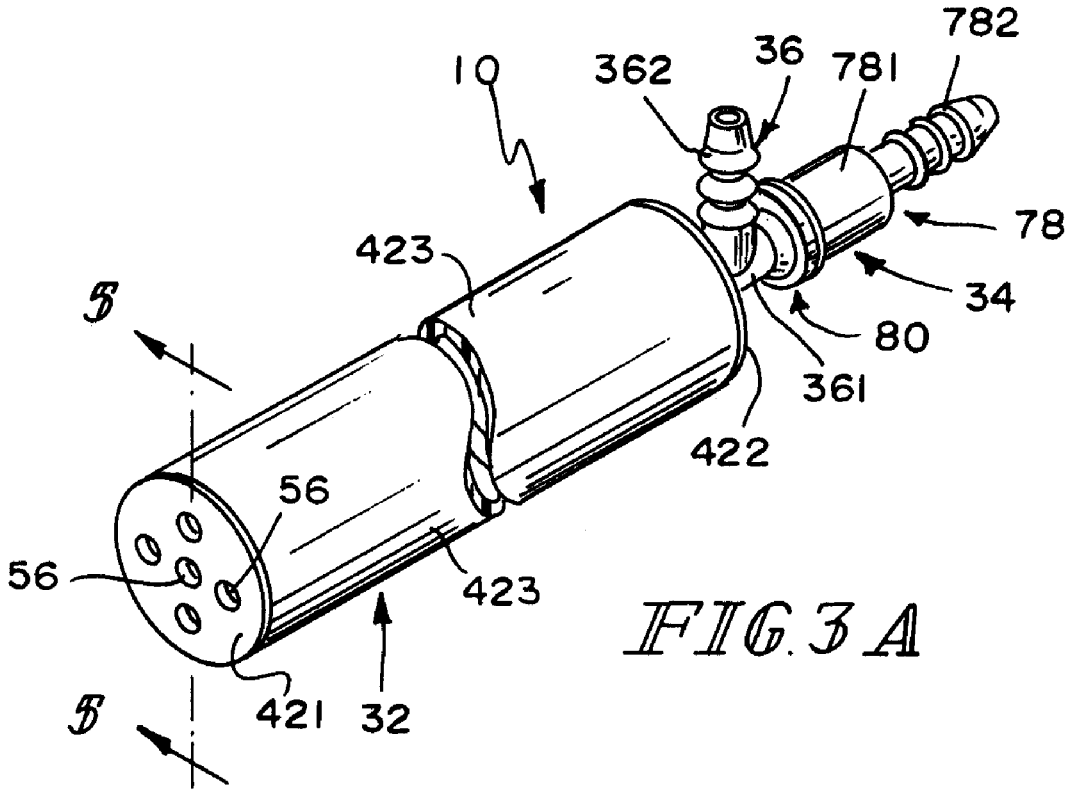
FIG. 3A is an enlarged perspective view of an illustrative embodiment of the fuel vapor recovery apparatus of FIGS. 1 and 2, with portions broken away, showing (in series) a cylindrical carbon canister, a T-shaped conduit, and a "one-way" check valve assembly.
Figure 3B:
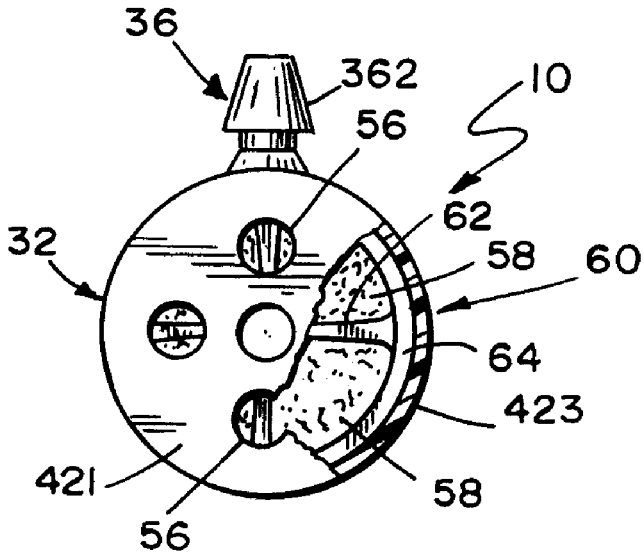
FIG. 3B is a "left-side" elevation view of the fuel vapor recovery apparatus of FIG. 3A, with portions broken away, showing a first filter backing plate lying in front of a first filter located in an interior region formed in the carbon canister.

In an illustrative embodiment, housing 42 includes a cylindrical sleeve 423 interposed between first and second end closures 411, 412 as suggested in FIGS. 3A and 5. It is within the scope of this disclosure to provide sleeve 423 with any suitable length and shape and form end closures 411, 412 to mate with sleeve 423. One end of sleeve 423 is formed to include atmosphere orifice 401 and another end of sleeve 423 is formed to include tank-and-engine orifice 402.

Canister 32 is configured to allow both fuel tank fuel vapor and atmospheric air to pass through carbon bed 44. Canister 32 is configured to "clean" fuel vapor 46 vented from fuel tank 24 during, for example, a fuel tank fuel vapor venting cycle that takes place during tank refueling as suggested diagrammatically in FIG. 5. Canister 32 is "cleaned" or "purged" using a vacuum provided by engine intake 48 (e.g., carburetor 26) during a carbon bed cleaning cycle that takes place when engine 22 is running as suggested diagrammatically in FIG. 6.

In use, when engine 22 is off during fuel tank refueling, hydrocarbon material (not shown) entrained in fuel vapor 46 discharged from fuel tank 24 and passed through carbon bed 44 is captured or stored (e.g., adsorbed) on charcoal granules included in carbon bed 44 as that fuel vapor 46 is passed through carbon bed 44. A stream of cleaned vapor 50 is discharged from canister 32 to the atmosphere 52 through atmosphere orifice 401 during a vapor-cleaning process as suggested diagrammatically in FIG. 5.

When engine 22 is running, a purge vacuum 94 is applied to carbon bed 44 in housing 42 of canister 32 through tank-and-engine orifice 402 as suggested in FIG. 6. Atmospheric air 97 is drawn into housing 42 through atmospheric orifice 401 and passes through carbon bed 44 to purge hydrocarbon material from carbon bed 44 and discharge it as fuel vapor stream 101 from housing 42 through tank-and-engine orifice 402 as suggested in FIG. 6.

First end closure 411 comprises a first end cap 421 in an illustrative embodiment as suggested in FIGS. 5 and 6. Second end closure 412 comprises a second end cap 422 and a three-way vapor conduit 36 coupled to second end cap 422 as suggested in FIGS. 4-6. In the illustrated embodiment, three-way vapor conduit 36 includes a first tube section 361 formed to include a housing channel 361*h*, a second tube section 362 formed to include a tank channel 362*t*, and a third tube section 363 formed to include a vacuum channel 363*v* as suggested in FIGS. 4-6. Housing channel 361*h*, tank channel 362*t*, and vacuum channel 363*v* merge with one another in fluid communication at a junction "J" located inside three-way vapor conduit 36 as shown, for example, in FIGS. 4-6.

Figure 4:
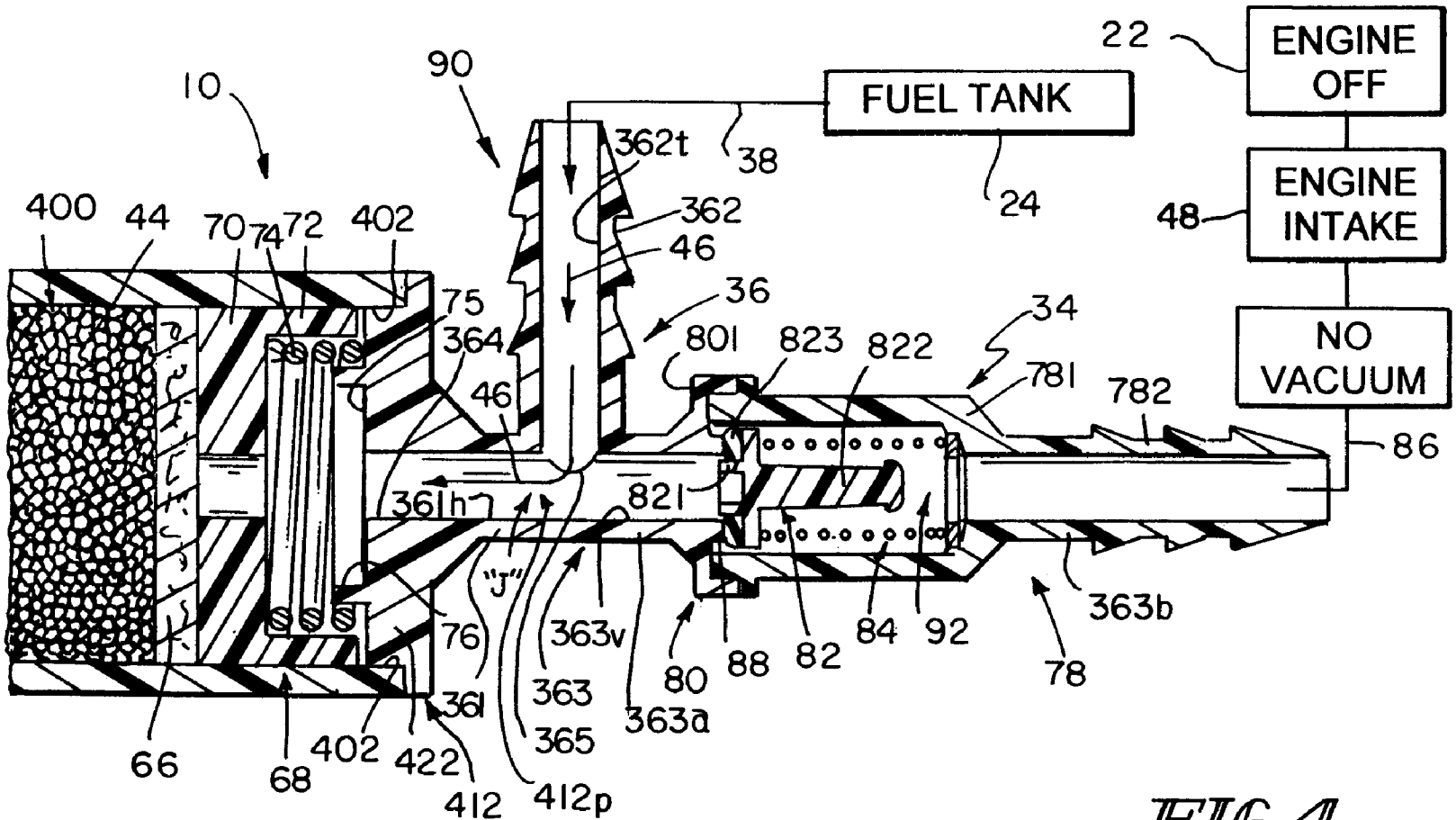
FIG. 4 is a portion of an enlarged sectional view taken along line 5-5 of FIG. 3A showing various components included in an illustrative embodiment of the fuel vapor recovery apparatus of FIGS. 3A and 3B.

As suggested in FIGS. 4-6, second end closure 412 is coupled to housing 42 to close tank-and-engine orifice 402. Second end closure 412 is formed to include a passageway 412*p* arranged to provide vapor/vacuum means for conducting inbound fuel vapor 46 from fuel tank 24 into interior region 400 of housing 42 and outbound fuel vapor 101 from interior region 400 of housing 42 to an engine intake 48 coupled to an engine 22 associated with fuel tank 24 as suggested in FIGS. 4-6. In the illustrated embodiment, shown in FIG. 4, second end cap 422 is formed to include an aperture 364 defining a "first portion" of vapor/vacuum means 412*p*.

Housing channel 361*h* defines a "second portion" of vapor/vacuum means 412*p*. Tank channel 362*t* defines a "third portion" of vapor/vacuum means 412*p*. Vacuum channel 363*v* defines a "fourth portion" of vapor/vacuum means 412*p*.

In an illustrative embodiment shown, for example, in FIG. 4, first tube section 361 of three-way vapor conduit 36 terminates at a tank hose mount adapted to mate with a tank hose or vapor line 38 configured to conduct fuel vapor 46 between fuel tank 24 and tank channel 362*t*. As also shown in FIG. 4, third tube section 363 of three-way vapor conduit 36 terminates at a vacuum hose mount adapted to mate with a vacuum hose or purge line 86 configured to conduct vacuum between vacuum channel 363*v* and engine intake 48.

As suggested in FIG. 4, third tube section 363 of three-way vapor conduit 36 includes a first portion 363*a* coupled to first and second tube sections 361, 362 and a second portion 363*b* coupled to first portion 363*a*. Second portion 363*b* is formed to include the vacuum hose mount as suggested in FIG. 4. In the illustrated embodiment, second end cap 422, first tube section 361, second tube section 362, and first portion 363*a* of third tube section 363 cooperate to define a monolithic element 90 made of a plastics material.

First end cap 421 of housing 42 is formed to include apertures 56 arranged to communicate with atmosphere 52 as suggested in FIGS. 2, 5, and 6. Interposed in series between carbon bed 44 and first end cap 421 is a porous first filter 58 and a first filter locator 60 comprising a filter backing plate 62 and a cylinder-shaped plate support 64 as shown, for example, in FIG. 5. Filter backing plate 62 is cross-shaped and is formed to include a central aperture 63 and four surrounding apertures as suggested in FIGS. 4 and 5. Further, interposed in series between carbon bed 44 and second end cap 421 is a porous second filter 66, a second filter locator 68 comprising a second filter backing plate 70 and a cylinder-shaped plate support 72, and a locator-biasing spring 74 surrounded, at least in part, by cylinder-shaped plate support 72 as suggested in FIG. 5. In an illustrative embodiment, second filter backing plate 70 has a shape similar to that of first filter backing plate 62.

Locator-biasing spring 74 is used to move second filter locator 68 inside housing 42 toward first filter locator 60 to compact carbon granules included in carbon bed 44 to govern the density of carbon granules in carbon bed 44. In the illustrated embodiment, an inner portion of locator-biasing spring 74 engages second filter backing plate 70 of second filter locator 68 and an outer portion of locator-biasing spring 74 engages an interior wall 75 of second end cap 422 and mates with a spring retainer 76 on that interior wall 75 as suggested in FIGS. 5 and 6. In the illustrated embodiment, locator-biasing spring 68 is a helical compression spring.

In the illustrated embodiment, third tube section 363 of three-way vapor conduit 36 is configured to include check valve assembly 34. Check valve assembly 34 includes a base 78, a cover 80, a valve 82, and a valve-control spring 84 as shown, for example, in FIGS. 5 and 6. Base 78 is formed to include a valve housing 781 and a housing tube 782 adapted to mate to a downstream portion of a vacuum purge line 86. Cover 80 is formed to include a cover plate 801 adapted to mate with first portion 363*a* of third tube section 363 and with valve housing 781. First portion 363*a* of third tube section 363 is formed to include an annular valve seat 88. Valve 82 includes a seal plate 821, a valve stem 822 coupled to seal plate 821 and arranged to extend away from cover 80, and an annular seal 823 mounted on seal plate 821 and arranged to mate with an annular valve seat 88 provided on cover 80 to provide a sealed connection between valve 82 and cover 80 upon movement of valve 82 to a channel-closing position as shown, for example, in FIG. 5.

As suggested in FIGS. 4-6, valve 82 is located in a part 92 of vacuum channel 363*v* formed in second portion 363*b* of third tube section 363. Valve-control spring 84 is located in vacuum channel 363*v* and arranged to yieldably urge valve 82 to a normally closed channel-closing position mating with annular valve seat 88 as suggested in FIGS. 4 and 5. In this position, flow of fuel vapor from housing channel 361*h* and tank channel 362*t* into the part 92 of vacuum channel 363*v* formed in second portion 363*b* of third tube section 363 is blocked. Valve-control spring 84 yields as suggested in FIG. 6 to allow valve 82 to move to a temporarily opened channel-opening position unmating from annular valve seat 88 to allow flow of fuel vapor from housing channel 361*h* into the part 92 of vacuum channel 363*v* formed in second portion 363*b* of third tube section 363.

During a tank-venting situation shown diagrammatically in FIG. 5, vented fuel vapor 46 is discharged from fuel tank 24 and flows through vapor line 38 and first and second tube sections 361, 362 of three-way vapor conduit 36 into carbon bed 44 in canister 32. Hydrocarbons (not shown) associated with vented fuel vapor 46 are captured by carbon bed 44 and cleaned vapor 50 is discharged from canister 32 through apertures 56 formed in first end cap 421 to atmosphere 52. During this fuel vapor-cleaning event, valve-control spring 84 urges valve 82 to mate with valve seat 88 on cover 80 as shown, for example, in FIG. 6 to assume a normal channel-closing position in valve housing 781 to block flow of fuel vapor extant in canister 32 and three-way vapor conduit 36 through a channel 92 formed in base 78 to engine 22.

Later on, when engine 22 is running, a purge vacuum 94 (generated using any suitable means) is applied to housing tube 782 via vapor purge line 86 to purge hydrocarbon material (not shown) from carbon bed 44 in canister 32. Application of purge vacuum 94 to channel 92 in valve housing 781 causes valve 82 to move away from valve seat 88 and against valve-control spring 84 to compress valve-control spring 84 as suggested in FIG. 6 to move valve 82 away from mating engagement with cover 80 to a "temporary" channel-opening position. Purge vacuum 94 is thus exposed to vapor in canister 32 and three-way vapor conduit 36. This causes atmospheric air 97 to be drawn into and through carbon bed 44 to produce a first stream 101 of fuel vapor (laden with hydrocarbons released from carbon bed 44) that mixes with a second stream 102 of fuel vapor discharged from fuel tank 24 into three-way vapor conduit 36 to produce a fuel vapor mixture 103 that passes through opened channel 92 in check valve assembly 34 and flows to engine 22 for combustion therein.

Figure 7:
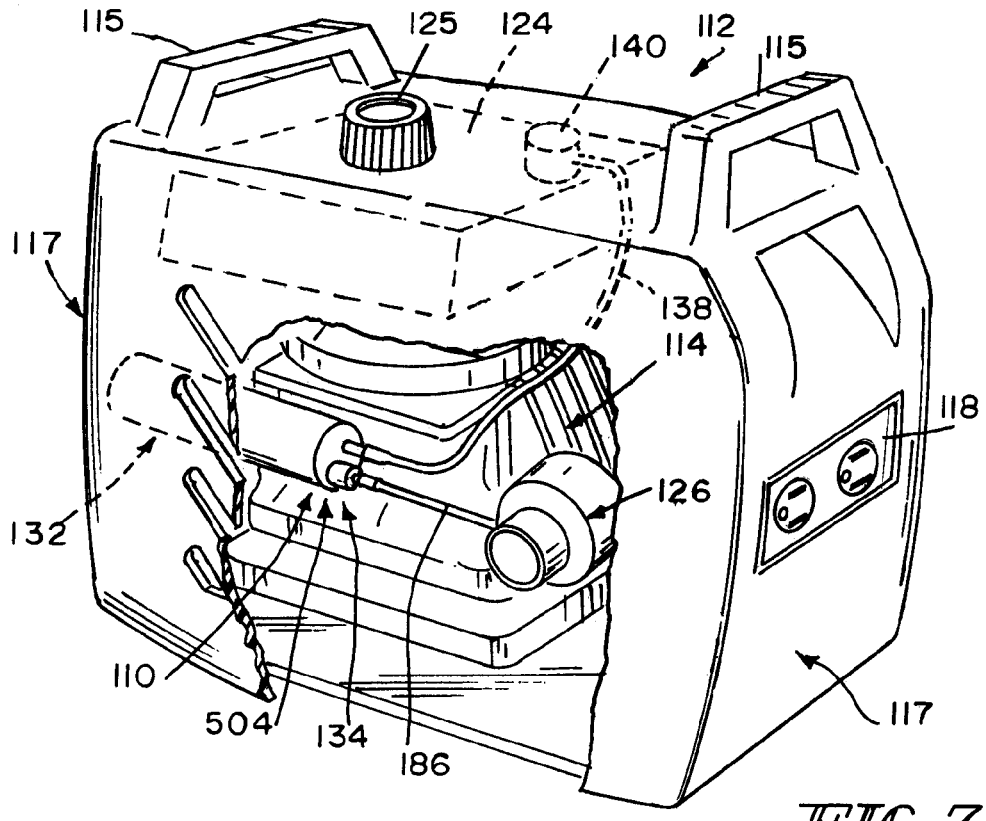
FIG. 7 is a perspective view of an electricity generator including a fuel vapor recovery apparatus in accordance with a second embodiment of the present disclosure and a fuel tank associated with a small internal combustion engine.

Electricity generator 112 includes a floor 116 covered by a shell 117 formed to include a pair of grip handles 115 and configured to support an electrical outlet 118 coupled to power source 114 included in electricity generator 112 as suggested in FIG. 7. Electricity generator 112 burns gasoline or other fuel to produce electricity that is accessed through electrical outlet 118. Power source 114 comprises a small internal combustion engine 122, a fuel tank 124 provided with a filler neck closed by fuel cap 125, and a carburetor 126 as shown, for example, in FIGS. 7 and 8. At least a portion of shell 117 covers fuel vapor recovery apparatus 110 as suggested in FIG. 7. It is within the scope of this disclosure to include fuel vapor recovery apparatus 110 in a power source associated with other outdoor tools and/or associated with other small internal combustion engines.

Figure 8:
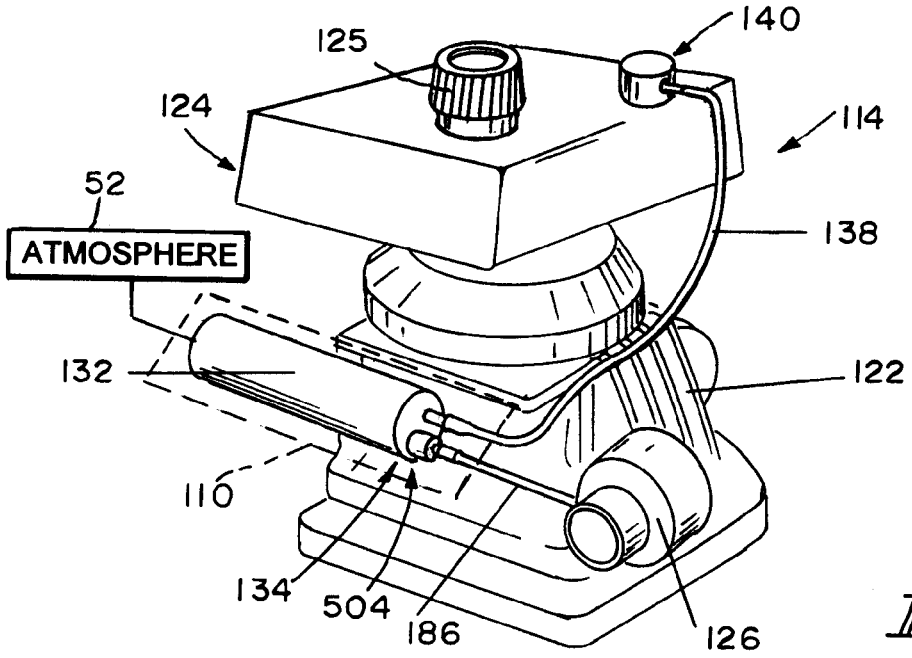
FIG. 8 is an enlarged perspective view of a power source included in the electricity generator of FIG. 7 showing a fuel vapor recovery apparatus comprising a carbon canister, a "one-way" check valve assembly adapted to be coupled to a vacuum source associated with a carburetor, and a vapor conduit arranged to mate with a vapor line coupled to a rollover valve associated with the fuel tank.
Figure 9:
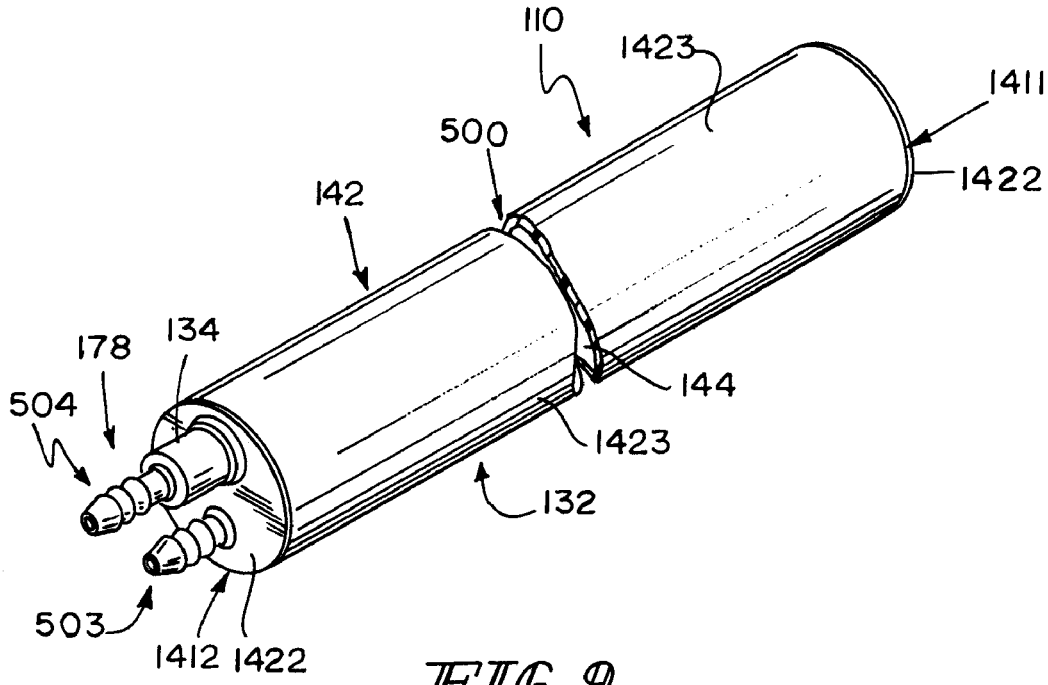
FIG. 9 is an enlarged perspective view of an illustrative embodiment of the fuel vapor recovery apparatus of FIGS. 7 and 8, with portions broken away, showing a cylindrical carbon canister, a "one-way" check valve assembly coupled to a first end of the carbon canister, and a vapor conduit coupled to the first end of the carbon canister.
Figure 10:
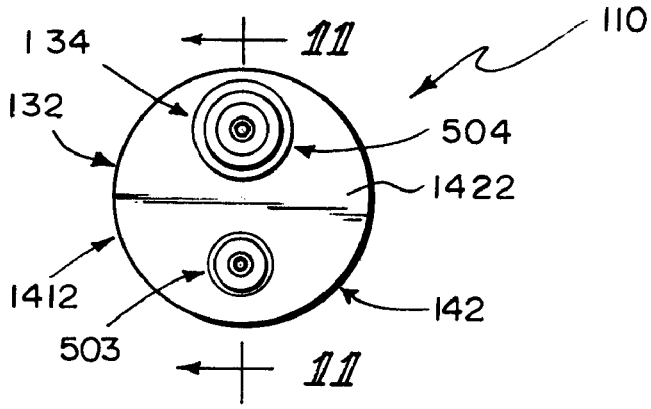
FIG. 10 is a "left-side" end elevation view of the fuel vapor recovery apparatus of FIG. 9, with portions broken away, showing the vapor conduit below the check valve assembly on the first end of the carbon canister.

As suggested, for example, in FIG. 8, fuel vapor recovery apparatus 110 includes a carbon canister 132, a check valve assembly 134, and a vapor conduit 136 arranged to mate with a vapor line 138 coupled to a rollover valve 140 associated with fuel tank 124. Rollover valve 140 regulates flow of fuel vapor and liquid fuel from an interior region of fuel tank 124 to fuel vapor recovery apparatus 110 via vapor line 138. Rollover valve 140 is configured to block discharge of fuel vapor and liquid fuel from fuel tank 124 to fuel vapor recovery apparatus 110 whenever rollover valve 140 is "inverted" or at least tilted a selected number of degrees from its normal upright position to minimize any chance that carbon granules stored in carbon canister 132 will be exposed to liquid fuel during a lawn mower "roll-over" situation.

Figure 11:
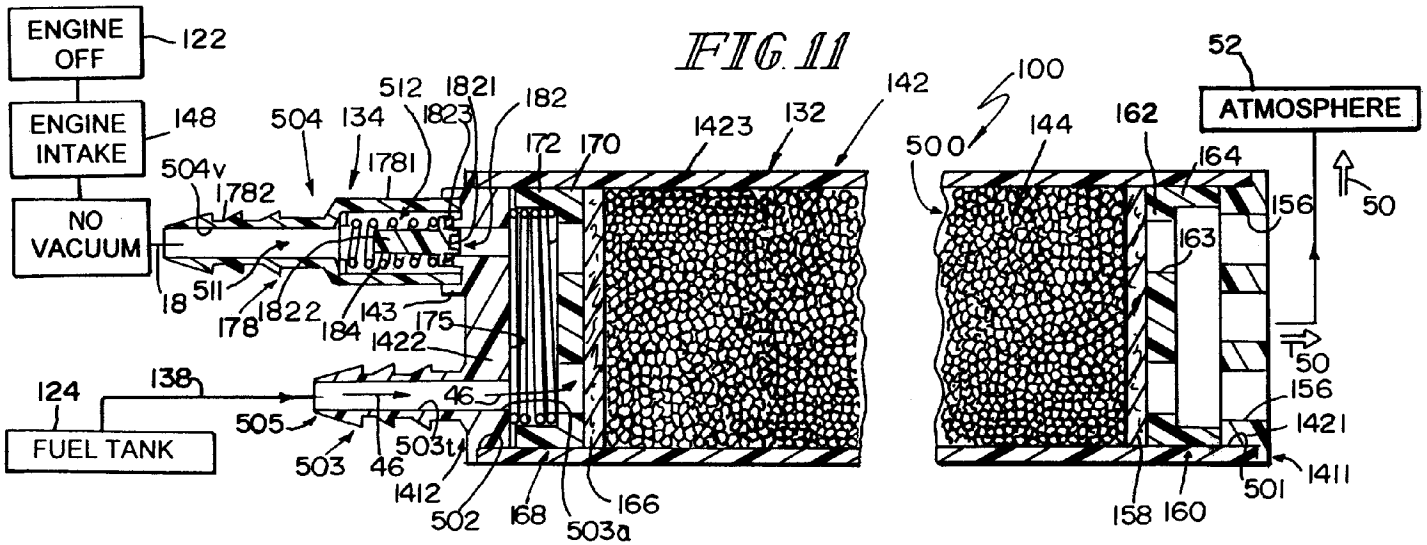
FIG. 11 is an enlarged sectional view taken along line 11-11 of FIG. 10 showing a spring-biased valve included in the check valve assembly in a normal channel-closing position to block flow of fuel vapor extant in the carbon canister through a channel in the check valve assembly to the engine while the engine is off and showing flow of vented fuel vapor from the fuel tank through the vapor conduit to cause hydrocarbons associated with the vented fuel vapor to be captured by a carbon bed in the carbon canister and showing cleaned vapor discharged from the canister to the atmosphere.
Figure 12:
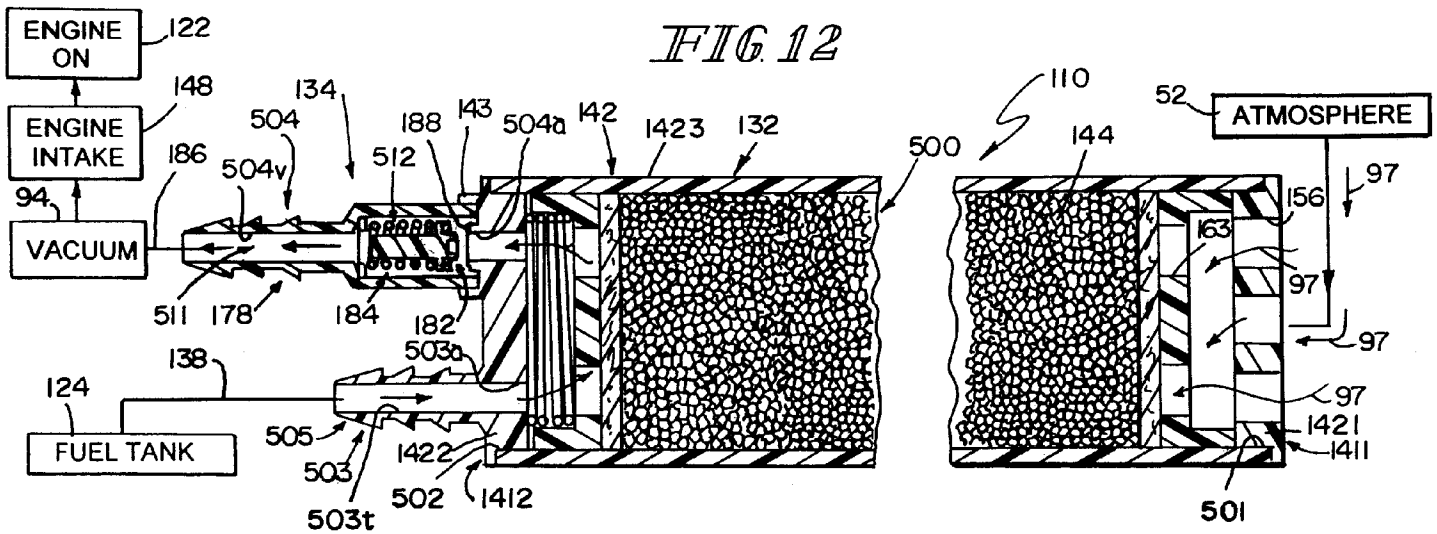
FIG. 12 is a sectional view similar to FIG. 11 showing "purging" of the carbon bed in the canister by means of a purge vacuum applied through an opened channel in the check valve assembly and the vapor conduit to the carbon bed when the engine is running to cause atmospheric air to be drawn through the carbon bed to produce a stream of fuel vapor (laden with hydrocarbons released from the carbon bed) that passes through the opened channel in the check valve assembly to the engine (for combustion therein) while the spring-biased valve is moved (by the purge vacuum) to a temporary channel-opening position.
Figure 13:
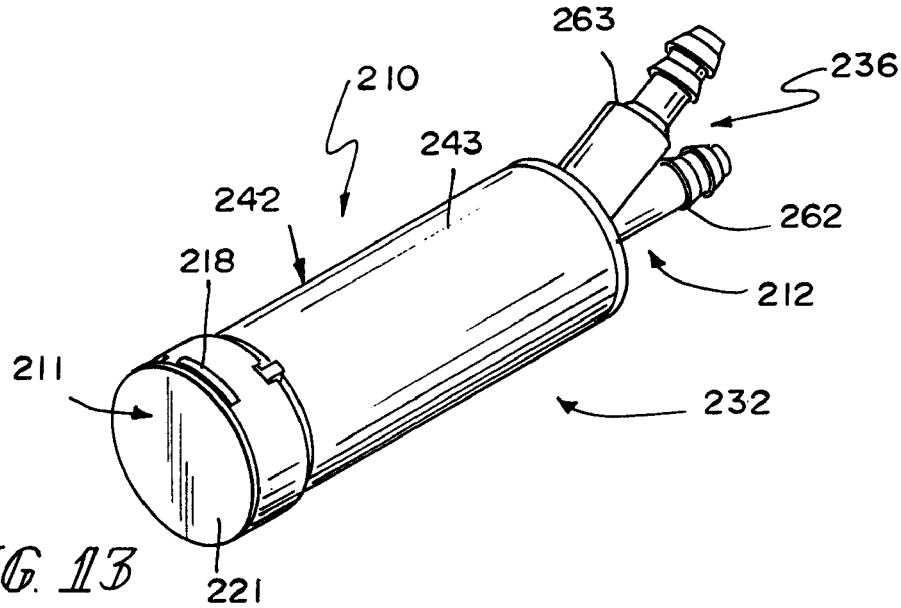
FIG. 13 is a perspective view of another illustrative embodiment of a fuel vapor recovery apparatus suitable for use in the environment of FIGS. 1 and 2 or FIGS. 7 and 8.
Figure 14:
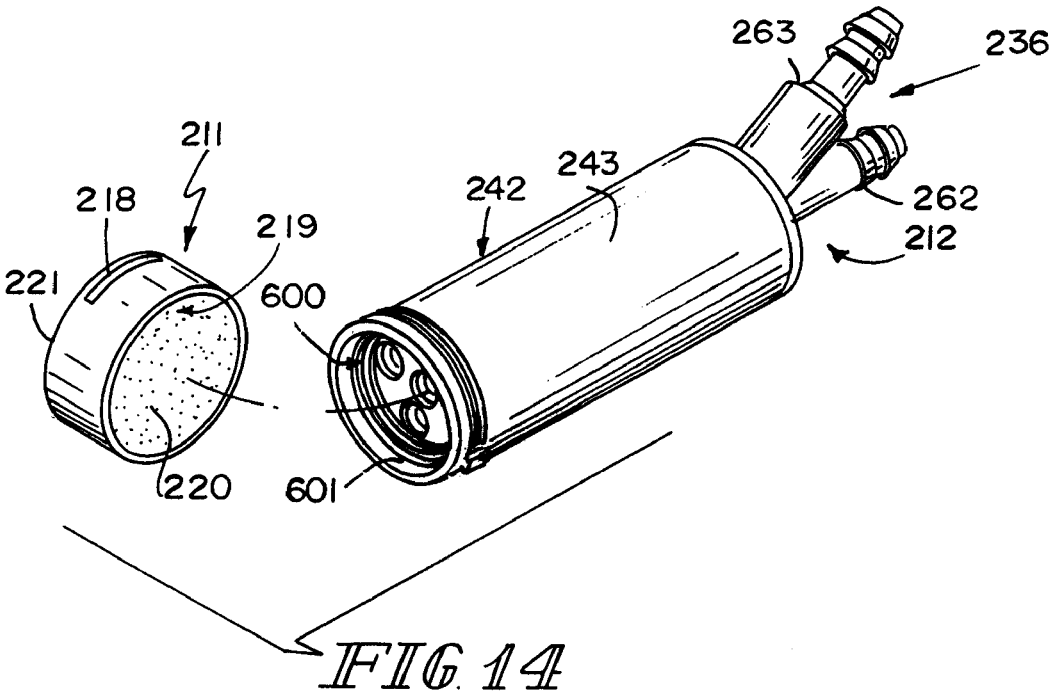
FIG. 14 is a view similar to FIG. 13 showing removal of a filter unit comprising a filter cap and a fresh-air foam filter retained in an interior region of the filter cap from a housing.
Figure 16:
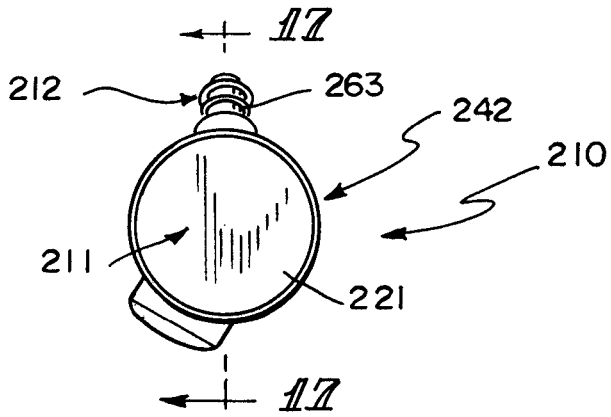
FIG. 16 is a left-end elevation of the fuel vapor recovery apparatus of FIG. 13.

Canister 132 has a housing 142 containing a carbon bed 144 as suggested in FIGS. 11 and 12 and is sized to fit into a canister-receiving cavity provided under shell 117 as suggested in FIG. 7. Housing 142 is formed to include an interior region 500 containing carbon bed 144, an atmosphere orifice 501 opening into interior region 500, and a tank-and-engine orifice 502 opening into interior region 500 as suggested in FIGS. 11 and 12. In an illustrative embodiment, housing 142 includes a cylindrical sleeve 1423 interposed between first and second end closures 1411, 1412 as suggested in FIGS. 9 and 11. It is within the scope of this disclosure to provide sleeve 1423 with any suitable length and shape and form end caps 1421, 1422 to mate with sleeve 1423. One end of sleeve 1423 is formed to include atmosphere orifice 501 and another end of sleeve 1423 is formed to include tank-and-engine orifice 502.

Canister 132 is configured to allow both fuel tank fuel vapor and atmospheric air to pass through carbon bed 144. Canister 132 is configured to "clean" fuel vapor 46 vented from fuel tank 124 during, for example, a fuel tank fuel vapor venting cycle that takes place during tank refueling as suggested diagrammatically in FIG. 11. Canister 132 is "cleaned" or "purged using a vacuum provided by engine intake 148 (e.g., carburetor 126) during a carbon bed cleaning cycle that takes place when engine 122 is running as suggested diagrammatically in FIG. 12.

In use, when engine 22 is off during fuel tank refueling, hydrocarbon material (not shown) entrained in fuel vapor 46 discharged from fuel tank 124 and passed through carbon bed 144 is captured or stored (e.g., adsorbed) on charcoal granules included in carbon bed 144 as that fuel vapor 46 passes through carbon bed 144. A stream of cleaned vapor 50 is discharged from canister 132 to the atmosphere 52 through atmosphere orifice 501 during a vapor-cleaning process as suggested diagrammatically in FIG. 11.

First end cap 1411 comprises a first end cap 1421 in an illustrative embodiment as suggested in FIGS. 11 and 12. Second end closure 1412 comprises a second end cap 1422, a vapor conduit 503, coupled to second end cap 1422, and a separate vacuum conduit 504 coupled to second end cap 1422 as suggested in FIGS. 11 and 12.

Vapor conduit 503 is configured to define vapor means for conducting inbound fuel vapor from a fuel tank 104 into interior region 500 of housing 142 to reach carbon bed 144 located in interior region 500 of housing 142 so that hydrocarbons associated with the inbound fuel vapor are captured by carbon bed 144. Vacuum conduit 504 is configured to define vacuum means for conducting outbound fuel vapor from interior region 500 of housing 142 toward an engine intake 148 coupled to an engine 122 associated with fuel tank 124 so that hydrocarbons released by carbon bed 144 and entrained in the outbound fuel vapor are burned in engine 122 after discharge from interior region 500 of housing 142.

Second end cap 1422 is coupled to housing 142 to close tank-and-engine orifice 502 and is formed to include a vapor aperture **503*a* defining a first portion of the vapor means and a vacuum aperture 504*a* defining a first portion of the vacuum means. A vapor tube 505 is coupled to second end cap 1422 at vapor aperture 503*a* and is formed to include a tank channel 503*t* defining a second portion of the vapor means. A base 78 is coupled to second end cap 1422 at vacuum aperture 504*a* and formed to include a vacuum channel 504*v*** defining a second portion of the vacuum means.

First end cap 1421 of housing 142 is formed to include apertures 156 arranged to communicate with atmosphere 52 as suggested in FIGS. 11 and 12. Interposed in series between carbon bed 144 and first end cap 1421 is a porous first filter 158 and a first filter locator 160 comprising a filter backing plate 162 and a cylinder-shaped plate support 164 as shown, for example, in FIG. 11. Filter backing plate 162 is formed to include apertures 163 as suggested in FIGS. 11 and 6. Further, interposed in series between carbon bed 144 and second end cap 1421 is a porous second filter 166, a second filter locator 168 comprising a second filter backing plate 170 and a cylinder-shaped plate support 172, and a locator-biasing spring 174 surrounded, at least in part, by cylinder-shaped plate support 172 as suggested in FIG. 11.

Locator-biasing spring 174 is used to move second filter locator 168 inside housing 142 toward first filter locator 160 to compact carbon granules included in carbon bed 144 to govern the density of carbon granules in carbon bed 144. In the illustrated embodiment, an inner portion of locator-biasing spring 174 engages second filter backing plate 170 of second filter locator 168 and an outer portion of locator-biasing spring 174 engages an interior wall 175 of second end cap 1422 as suggested in FIGS. 5 and 6. In the illustrated embodiment, locator-biasing spring 168 is a helical compression spring.

Check valve assembly 134 comprises a base 178, a valve 182, and a valve-control spring 184 as shown, for example, in FIGS. 11 and 12. Base 178 is formed to include a valve housing 1781 and a housing tube 1782 adapted to mate to a downstream portion of a vacuum purge line 186. Valve housing 1781 is coupled to second end cap 1422 at retainer 143. Valve 182 includes a seal plate 1821, a valve stem 1822 coupled to seal plate 1821 and arranged to extend away from second end cap 1422, and an annular seal 1823 mounted on seal plate 1821 and arranged to mate with an annular valve seat 188 provided on second end cap 1422 to provide a sealed connection between valve 182 and second end cap 1422 upon movement of valve 182 to a channel-closing position as shown, for example, in FIG. 11.

Vapor conduit 136 includes a vapor tube arranged to lie in spaced-apart parallel relation to base 178 as suggested in FIGS. 9-12. In an illustrative embodiment, a monolithic component 190 made of a plastics material is formed to include vapor conduit 503 and second end cap 1422 as shown, for example, in FIGS. 5 and 6.

Valve 182 is mounted for movement in a first segment 511 of vacuum channel located in valve housing 1781 and a valve control spring 184 located in first segment 511 of vacuum channel **504*v*. Valve control spring 184 is arranged yieldably to urge valve 182 to a normally closed channel-closing position mating with an annular valve seat 188 included in base 178 to block flow of fuel vapor from interior region 500 of housing 142 and first segment 511 of the vacuum channel 504*v* into a second segment 512 of vacuum channel 504*v* formed in the housing tube 1782 and to yield to allow flow of fuel vapor from interior region 500 of housing 142 and first segment 511 of vacuum channel 504*v* into second segment 512 of vacuum channel 504*v* formed in housing tube 1782**.

A distal portion of housing tube 1782 is formed to include a vacuum hose mount adapted to mate with a vacuum hose configured to provide the vacuum purge line. A distal portion of vapor conduit 503 is formed to include a tank hose mount adapted to mate with a tank hose configured to conduct fuel vapor between a fuel tank 124 and vapor conduit 503.

During a tank-venting situation shown diagrammatically in FIG. 11, vented fuel vapor 46 is discharged from fuel tank 124 and flows through vapor line 138 and vapor conduit 503 into carbon bed 144 in canister 132. Hydrocarbons (not shown) associated with vented fuel vapor 46 are captured by carbon bed 144 and cleaned vapor 50 is discharged from canister 132 through apertures 156 formed in first end cap 1421 to atmosphere 52. During this fuel vapor-cleaning event, valve-control spring 184 urges valve 182 to mate with valve seat 188 on second end cap 1422 as shown, for example, in FIG. 12 to assume a normal channel-closing position in valve housing 1781 to block flow of fuel vapor extant in canister 110 and vapor conduit 504 through a channel 512 formed in base 178 to engine 122.

Later on, when engine 122 is running, a purge vacuum 94 (generated using any suitable means) is applied to housing tube 1782 via a vapor purge line 186 to purge hydrocarbon material (not shown) from carbon bed 144 in canister 132. Application of purge vacuum 94 to channel 512 in valve housing 1781 causes valve 182 to move away from valve seat 188 against valve-control spring 184 to compress valve-control spring 184 as suggested in FIG. 12 to move valve 182 away from mating engagement with valve seat 188 to a "temporary" channel-opening position. Purge vacuum 94 is thus exposed to vapor in canister 132 and vapor conduit 503. This causes atmospheric air 97 to be drawn into and through carbon bed 144 to produce a first stream of fuel vapor (laden with hydrocarbons released from carbon bed 144) that mixes with a second stream of fuel vapor discharged from fuel tank 124 into vapor conduit 503 to produce a fuel vapor mixture that passes through opened channel 512 in check valve assembly 134 and flows to engine 122 for combustion therein.

As suggested in FIGS. 13-17, an alternative fuel vapor recovery apparatus 210 comprises a housing 242 formed to include an interior region 600 containing a carbon bed 244. Housing 242 is also formed to include an atmosphere orifice 601 opening into interior region 600, and a tank-and-engine orifice 602 opening into interior region 600 as suggested in FIG. 17.

In an illustrative embodiment, housing 242 includes a cylindrical sleeve 243 interposed between first and second end closures 211, 212 as suggested in FIG. 7. It is within the scope of this disclosure to provide sleeve 243 with any suitable length and shape and form end closures 211, 212 to mate with sleeve 243. One end of sleeve 243 is formed to include atmospheric orifice 601 and another end of sleeve 243 is formed to include tank-and-engine orifice 602. Housing 242 and first and second end closures 211, 212 cooperate to define a carbon canister 232.

Figure 17:
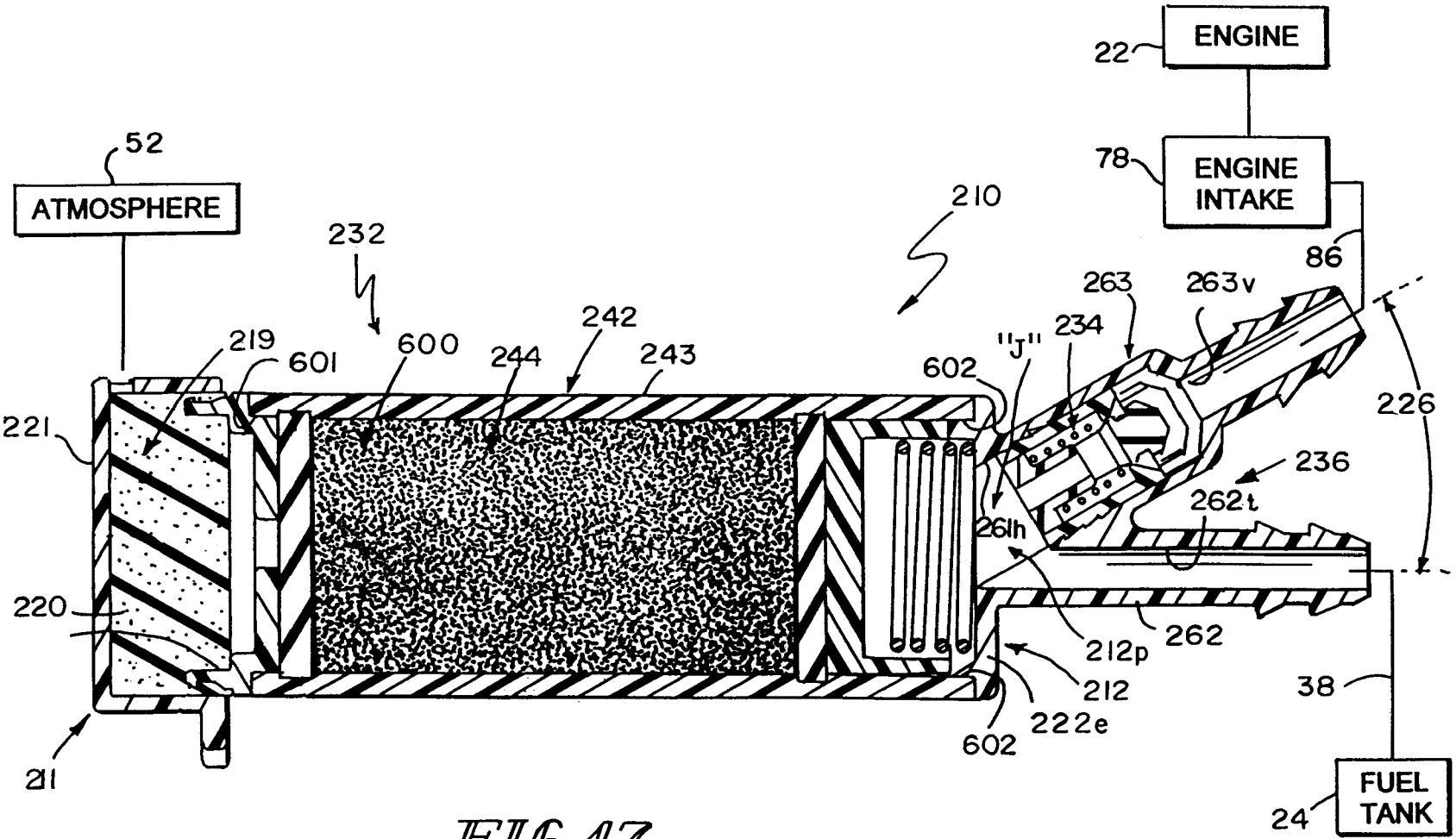
FIG. 17 is an enlarged sectional view taken along line 17-17 of FIG. 16 showing a carbon canister housing containing a carbon bed, a filter unit coupled to a left-end of the housing, and a "two-way" vapor conductor coupled to the right-end of the housing and formed to include a vapor tube adapted to be coupled to a fuel tank and a vacuum tube adapted to be coupled to an engine intake associated with an engine and configured to contain a vacuum-actuated check valve.

First end closure 211 comprises a filter cap 221 formed to include an interior region 219 containing an air filter 220 made, for example, of a porous foam material as suggested in FIG. 17. Filter cap 221 is formed to include a port 219 in communication with the atmosphere 252.

Figure 15:
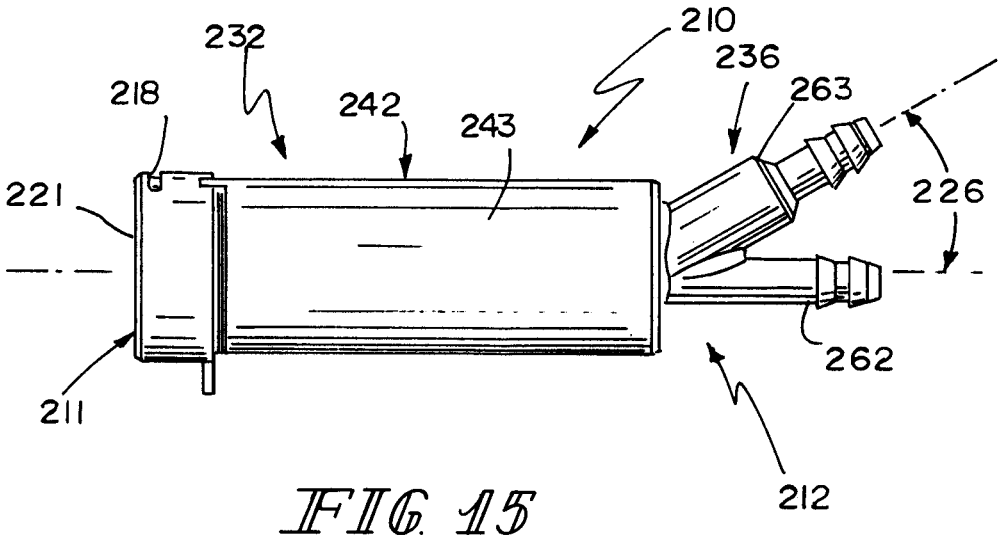
FIG. 15 is a side elevation view of the fuel vapor recovery apparatus of FIG. 13.

Second end closure 212 comprises a second end cap 222 and a two-way vapor conduit 236 coupled to second end cap 222 as suggested in FIGS. 15 and 17. In the illustrated embodiment, two-way conduit 236 includes a lower tube section 262 formed to include a tank channel **262*t* and an upper tube section 263 formed to include a vacuum channel 263*v* as suggested in FIG. 17. A housing channel (or aperture) 261*h* is formed in an end plate 222*e* of second end cap 222. Housing channel or aperture 261*h*, tank channel 262*t*, and vacuum channel 263*v* merge with one another in fluid communication at a junction "J" located inside second end closure 212 as shown, for example, in FIG. 17**.

As suggested in FIG. 17, second end closure 212 is coupled to housing 242 to close tank-and-engine orifice 602. Second end closure 212 is formed to include a passageway **212*p* arranged to provide vapor/vacuum means for conducting inbound fuel vapor from fuel tank 24 into interior region 600 of housing 242 and outbound fuel vapor from interior region 600 of housing 242 to an engine intake 48 coupled to an engine 22 associated with fuel tank 24 as suggested in FIG. 17. In the illustrated embodiment shown in FIG. 17, housing channel or aperture 261*h* defines a "first portion" of vapor/vacuum means 212*p*, tank channel 262*t* defines a "second portion" thereof, and vacuum channel 263*v*** defines a "third portion" thereof.

In an illustrative embodiment shown, for example, in FIG. 17 lower tube section 262 of two-way vapor conduit 236 terminates at a tank hose mount adapted to mate with a tank house or vapor line 38 configured to conduct fuel vapor between fuel tank 24 and tank channel **262*t*. As also shown in FIG. 17, upper tube section 263 of two-way vapor conduit 236 terminates at a vacuum hose mount adapted to make with a vacuum hose or purge line 86 configures to conduct vacuum between vacuum channel 263*v* and engine intake 48**.

In an illustrative embodiment shown in FIG. 17, lower and upper tube sections 262, 263 cooperate to define an acute angle 226 therebetween. Included angle 26 is, for example, about 26°.

It is within the scope of this disclosure to provide a suitable normally closed vacuum-actuated channel-opening valve means 234 in vacuum channel **263*v* as suggested in FIG. 17. Such valve means operates in a manner similar to the valve means illustrated in FIGS. 4-6** or in another suitable manner.

The components (including carbon bed 244) provided inside sleeve 243 of housing 244 are similar to those internal components shown in FIGS. 4-6. Moreover, fuel vapor recovery apparatus 210 operates, for example, in a manner similar to fuel vapor recovery apparatus 10 shown, for example, in FIGS. 4-6.

The invention claimed is:

1. A fuel vapor recovery apparatus comprising a carbon canister including a housing formed to include an interior region, an atmosphere orifice opening into the interior region, and a tank-and-engine orifice opening into the interior region, and a carbon bed located in the interior region between the atmosphere orifice and the tank-and-engine orifice, and flow control means for discharging fuel vapor exhausted from a fuel tank into the interior region of the housing through the tank-and-engine orifice to flow through the carbon bed in a direction toward the atmosphere orifice during a fuel tank fuel vapor venting cycle and for applying a vacuum generated by an engine intake when an engine coupled to the engine intake is running to the interior region of the housing through the tank-and-engine orifice to cause atmospheric air to be drawn into the interior region through the atmosphere orifice and into and through the carbon bed to produce a first stream of fuel vapor that exits the housing through the tank-and-engine orifice and through a check valve responsive to the vacuum generated by the engine intake for combustion in the engine during a carbon bed cleaning cycle;

wherein the carbon canister further includes an end closure coupled to the housing to close the tank-and-engine orifice and formed to include a passageway arranged to provide vapor/vacuum means for conducting inbound fuel vapor from a fuel tank into the interior region of the housing and outbound fuel vapor from the interior region of the housing to an engine intake coupled to an engine associated with the fuel tank; and wherein the end closure includes an end cap coupled to the housing to close the tank-and-engine orifice and formed to include an aperture defining a first portion of the vapor/vacuum means and a three-way vapor conduit including a first tube section formed to include a housing channel defining a second portion of the vapor/vacuum means, a second tube section formed to include a tank channel defining a third portion of the vapor/vacuum means and terminating at a tank hose mount adapted to mate with a tank hose configured to conduct fuel vapor between the fuel tank and the tank channel, and a third tube section formed to include a vacuum channel defining a fourth portion of the vapor/vacuum means, merging with the housing and tank channels at a junction located inside the three-way vapor conduit, and terminating at a vacuum hose mount adapted to mate with a vacuum hose configured to conduct vacuum between the vacuum channel and the engine intake.

2. The apparatus of claim 1, wherein a first portion of the third tube section is formed to include an annular valve seat, and wherein the three-way vapor conduit further comprises a valve located in a part of the vacuum channel formed in a second portion of the third tube section and a valve-control spring located in the vacuum channel and arranged to yieldably urge the valve to a normally closed channel-closing position mating with the annular valve seat to block flow of fuel vapor from the housing channel and the tank channel into the part of the vacuum channel formed in the second portion of the third tube section and to yield to allow the valve to move to a temporarily opened channel-opening position unmating from the annular valve seat to allow flow of fuel vapor from the housing channel into the part of the vacuum channel formed in the second portion of the third tube section.

3. The apparatus of claim 1, wherein the third tube section includes a first portion coupled to the first and second tube sections and a second portion coupled to the first portion and formed to include the vacuum hose mount and wherein the end cap, first tube section, second tube section, and first portion of the third tube section cooperate to define a monolithic element made of a plastics material.

4. The apparatus of claim 3, wherein the first portion of the third tube section is formed to include an annular valve seat, and wherein the three-way vapor conduit further comprises a valve located in a part of the vacuum channel formed in the second portion of the third tube section and a valve-control spring located in the vacuum channel and arranged to yieldably urge the valve to a normally closed channel-closing position mating with the annular valve seat to block flow of fuel vapor from the housing channel and the tank channel into the part of the vacuum channel formed in the second portion of the third tube section and to yield to allow the valve to move to a temporarily opened channel-opening position unmating from the annular valve seat to allow flow of fuel vapor from the housing channel into the part of the vacuum channel formed in the second portion of the third tube section.

5. A fuel vapor recovery apparatus comprising a carbon canister including a housing formed to include an interior region, an atmosphere orifice opening into the interior region, and a tank-and-engine orifice opening into the interior region, and a carbon bed located in the interior region between the atmosphere orifice and the tank-and-engine orifice, and flow control means for discharging fuel vapor exhausted from a fuel tank into the interior region of the housing through the tank-and-engine orifice to flow through the carbon bed in a direction toward the atmosphere orifice during a fuel tank fuel vapor venting cycle and for applying a vacuum generated by an engine intake when an engine coupled to the engine intake is running to the interior region of the housing through the tank-and-engine orifice to cause atmospheric air to be drawn into the interior region through the atmosphere orifice and into and through the carbon bed to produce a first stream of fuel vapor that exits the housing through the tank-and-engine orifice and through a check valve responsive to the vacuum generated by the engine intake for combustion in the engine during a carbon bed cleaning cycle;

wherein the carbon canister further includes an end closure coupled to the housing to close the tank-and-engine orifice and formed to include a passageway arranged to provide vapor/vacuum means for conducting inbound fuel vapor from a fuel tank into the interior region of the housing and outbound fuel vapor from the interior region of the housing to an engine intake coupled to an engine associated with the fuel tank; and wherein the end closure includes an end cap coupled to the housing to close the tank-and-engine orifice and formed to include an aperture defining a first portion of the vapor/vacuum means, a check valve assembly, and a three-legged vapor conductor having a first leg coupled to the end cap to receive fuel vapor through the aperture, a second leg adapted to be coupled to a fuel tank vapor line to receive fuel vapor from a fuel tank, and a third leg coupled to the check valve assembly and also to the first and second legs at a junction to discharge fuel vapor from the first and second legs to the check valve assembly.

6. The apparatus of claim 5, wherein the end cap and the three-legged conductor cooperate to define a monolithic element made of a plastics material.

7. A fuel vapor recovery apparatus comprising a carbon canister including a housing formed to include an interior region, an atmosphere orifice opening into the interior region, and a tank-and-engine orifice opening into the interior region, and a carbon bed located in the interior region between the atmosphere orifice and the tank-and-engine orifice, and flow control means for discharging fuel vapor exhausted from a fuel tank into the interior region of the housing through the tank-and-engine orifice to flow through the carbon bed in a direction toward the atmosphere orifice during a fuel tank fuel vapor venting cycle and for applying a vacuum generated by an engine intake when an engine coupled to the engine intake is running to the interior region of the housing through the tank-and-engine orifice to cause atmospheric air to be drawn into the interior region through the atmosphere orifice and into and through the carbon bed to produce a first stream of fuel vapor that exits the housing through the tank-and-engine orifice and through a check valve responsive to the vacuum generated by the engine intake for combustion in the engine during a carbon bed cleaning cycle:

wherein the carbon canister further includes an end closure coupled to the housing to close the tank-and-engine orifice and formed to include a passageway arranged to provide vapor/vacuum means for conducting inbound fuel vapor from a fuel tank into the interior region of the housing and outbound fuel vapor from the interior region of the housing to an engine intake coupled to an engine associated with the fuel tank; and wherein the end closure includes an end cap coupled to the housing to close the tank-and-engine orifice and formed to include an aperture defining a first portion of the vapor/vacuum means and a two-way vapor conduit including lower and upper tube sections, the lower tube section is formed to include a tank channel defining a second portion of the vapor/vacuum means and terminating at a tank hose mount adapted to mate with a tank hose configured to conduct fuel vapor between the fuel tank and the tank channel, and the upper tube section is formed to include a vacuum channel defining a third portion of the vapor/vacuum means, merging with the aperture and tank channel at a junction located inside the two-way vapor conduit, and terminating at a vacuum hose mount adapted to mate with a vacuum hose configured to conduct vacuum between the vacuum channel and the engine intake.

8. The apparatus of claim 7, wherein the upper and lower tube sections cooperate to define an included angle of about 26° therebetween.

9. The apparatus of claim 7, wherein the upper tube section, the lower tube section, and the end cap cooperate to define a monolithic element made of a plastics material.

10. The apparatus of claim 7, wherein the two-way vapor conduit further includes a valve located in the vacuum channel and a valve-control spring located in the vacuum channel and arranged to yieldably urge the valve to a normally closed channel-closing position mating with an annular valve scat associated with the vacuum channel to block flow of fuel vapor from the aperture in the end cap and the tank channel into a part of the vacuum channel formed in the vacuum hose mount and to yield to allow the valve to move to a temporarily opened channel-opening position unmating from the annular valve seat to allow flow of fuel vapor from the aperture formed in the end cap into the part of the vacuum channel formed in the vacuum hose mount for delivery to the engine intake and the engine.

11. A fuel vapor recovery apparatus comprising a carbon canister including a housing formed to include an interior region, an atmosphere orifice opening into the interior region, and a tank-and-engine orifice opening into the interior region, and a carbon bed located in the interior region between the atmosphere orifice and the tank-and-engine orifice, and flow control means for discharging fuel vapor exhausted from a fuel tank into the interior region of the housing through the tank-and-engine orifice to flow through the carbon bed in a direction toward the atmosphere orifice during a fuel tank fuel vapor venting cycle and for applying a vacuum generated by an engine intake when an engine coupled to the engine intake is running to the interior region of the housing through the tank-and-engine orifice to cause atmospheric air to be drawn into the interior region through the atmosphere orifice and into and through the carbon bed to produce a first stream of fuel vapor that exits the housing through the tank-and-engine orifice and through a check valve responsive to the vacuum generated by the engine intake for combustion in the engine during a carbon bed cleaning cycle; and wherein the carbon canister further includes an end closure coupled to the housing to close the tank-and-engine orifice and formed to include a vapor conduit and a separate vacuum conduit, the vapor conduit is configured to define vapor means for conducting inbound fuel vapor from a fuel tank into the interior region of the housing to reach the carbon bed located in the interior region of the housing so that hydrocarbons associated with the inbound fuel vapor are captured by the carbon bed, and the vacuum conduit is configured to define vacuum means for conducting outbound fuel vapor from the interior region of the housing toward an engine intake coupled to an engine associated with the fuel tank so that hydrocarbons released by the carbon bed and entrained in the outbound fuel vapor are burned in the engine after discharge from the interior region of the housing.

12. The apparatus of claim 11, wherein the end closure includes an end cap coupled to the housing to close the tank-and-engine orifice and formed to include a vapor aperture defining a first portion of the vapor means and a vacuum aperture defining a first portion of the vacuum means, a vapor tube coupled to the end cap at the vapor aperture and formed to include a tank channel defining a second portion of the vapor means, and a base coupled to the end cap at the vacuum aperture and formed to include a vacuum channel defining a second portion of the vacuum means.

13. The apparatus of claim 12, wherein the end cap and the tube cooperate to define a monolithic element made of a plastics material.

14. The apparatus of claim 12, wherein the base is formed to include a housing tube adapted to mate with a vacuum purge line and a valve housing arranged to lie between the housing tube and the end cap, and further comprising a valve mounted for movement in a first segment of the vacuum channel located in the valve housing and a valve control spring located in the first segment of the vacuum channel and arranged yieldably to urge the valve to a normally closed channel-closing position mating with an annular valve seat included in the base to block flow of fuel vapor from the interior region of the housing and the first segment of the vacuum channel into a second segment of the vacuum channel formed in the housing tube and to yield to allow flow of fuel vapor from the interior region of the housing and the first segment of the vacuum channel into the second segment of the vacuum channel formed in the housing tube.

15. The apparatus of claim 14 wherein a distal portion of the housing tube is formed to include a vacuum hose mount adapted to mate with a vacuum hose configured to provide the vacuum purge line.

16. The apparatus of claim 12, wherein a distal portion of the vapor tube is formed to include a tank hose mount adapted to mate with a tank hose configured to conduct fuel vapor between a fuel tank and the vapor tube.

17. A fuel vapor recovery apparatus comprising a carbon canister including a housing formed to include an interior region, an atmosphere orifice opening into the interior region, a tank-and-engine orifice opening into the interior region, and a carbon bed located in the interior region between the atmosphere orifice and the tank-and-engine orifice, and an end closure including an end cap, a check valve assembly, and a three-legged vapor conductor interposed between the end cap and the check valve assembly, wherein the end cap is coupled to the housing to close the tank-and-engine orifice and formed to include an aperture and the check valve assembly is formed to include an aperture, and the three-legged vapor conductor includes a first leg coupled to the end cap to receive fuel vapor through the aperture formed in the end cap, a second leg adapted to be coupled to a fuel tank vapor line to receive fuel vapor from a fuel tank, and a third leg coupled to the aperture of the check valve assembly and also to the first and second legs at a junction to discharge fuel vapor from the first and second legs into the check valve assembly through the aperture of the check valve assembly.

18. A fuel vapor recovery apparatus comprising a carbon canister including a housing formed to include an interior region, an atmosphere orifice opening into the interior region, a tank-and-engine orifice opening into the interior region, and a carbon bed located in the interior region between the atmosphere orifice and the tank-and-engine orifice, and an end cap closure including an end cap, a tank conduit, and a vacuum conduit, and wherein the end cap is coupled to the housing to close the tank-and-engine orifice and formed to include a vapor aperture and a vacuum aperture, the tank conduit is coupled to the end cap at the vapor aperture, the vapor conduit is coupled to the end cap at the vacuum aperture, and further comprising a valve mounted for movement in a channel formed in the vacuum conduit and a valve control spring located in the vacuum conduit and arranged yieldably to urge the valve to a normally closed channel-closing position mating with an annular valve seat included in the vacuum conduit to block flow of fuel vapor from the interior region of the housing through the channel formed in the vacuum conduit and to yield to allow flow of fuel vapor from the interior region of the housing and through the channel formed in the vacuum conduit.

* * * * *